US012710207B2

(12) United States Patent
Mai

(10) Patent No.: US 12,710,207 B2
(45) Date of Patent: Aug. 18, 2026

(54) VARIABLE REFRIGERANT FLOW SYSTEM AND CONTROL METHOD

(71) Applicant: Guangdong Carrier HVAC Co., Ltd., Foshan City (CN)

(72) Inventor: Xiangshi Mai, Foshan (CN)

(73) Assignee: GUANGDONG CARRIER HVAC CO., LTD., Foshan City (CN)

( * ) Notice: Subject to any disclaimer, the term of this patent is extended or adjusted under 35 U.S.C. 154(b) by 533 days.

(21) Appl. No.: 18/190,705

(22) Filed: Mar. 27, 2023

(65) Prior Publication Data

US 2023/0304708 A1 Sep. 28, 2023

(30) Foreign Application Priority Data

Mar. 28, 2022 (CN) ..... 202210314446.6

(51) Int. Cl.

| | |
|---|---|
| ***F25B 41/40*** | (2021.01) |
| ***F25B 13/00*** | (2006.01) |
| ***F25B 41/26*** | (2021.01) |
| ***F25B 49/02*** | (2006.01) |

(52) U.S. Cl.

CPC ..... *F25B 41/40* (2021.01); *F25B 13/00* (2013.01); *F25B 41/26* (2021.01); *F25B 49/02* (2013.01); *F25B 2313/02743* (2013.01); *F25B 2400/21* (2013.01)

(58) Field of Classification Search

CPC ..... F25B 41/40; F25B 13/00; F25B 41/26; F25B 49/02; F25B 2313/02743; F25B 2313/0292; F25B 2313/0233; F25B 2313/007; F25B 2313/021; F25B 2400/21; F25B 47/02; F25B 41/42; F25B 41/20; F24F 1/68; F24F 5/0021; F24F 11/65; F24F 12/00

See application file for complete search history.

(56) References Cited

FOREIGN PATENT DOCUMENTS

| | | | | | |
|---|---|---|---|---|---|
| CN | 1281128 | A | * | 1/2001 | ..... F24F 5/0017 |
| CN | 109737631 | A | * | 5/2019 | |
| CN | 112050329 | A | | 12/2020 | |
| CN | 112594824 | A | * | 4/2021 | ..... F25B 49/02 |
| CN | 112594871 | A | | 4/2021 | |
| CN | 113154731 | A | | 7/2021 | |
| JP | 2002277097 | A | * | 9/2002 | |
| JP | 2005337663 | A | * | 12/2005 | |
| JP | 2005337664 | A | * | 12/2005 | ..... F28D 1/0477 |
| JP | 2005337666 | A | * | 12/2005 | |

OTHER PUBLICATIONS

European Search Report for Application No. 23164840.3, Issued Sep. 6, 2023, 8 Pages.

* cited by examiner

*Primary Examiner* — Kun Kai Ma

(74) *Attorney, Agent, or Firm* — CANTOR COLBURN LLP

(57) ABSTRACT

A variable refrigerant flow (VRF) system, which includes: a first outdoor unit, the first outdoor unit at least including three external interfaces, namely, a gas-side stop valve, a liquid-side stop valve, and a multi-functional pipe stop valve; a first indoor unit, two ends of a refrigerant pipeline of the first indoor unit being respectively in communication with the gas-side stop valve and the liquid-side stop valve; and a replaceable module, one end of a refrigerant pipeline of the replaceable module being in communication with the multi-functional pipe stop valve, and the other end being in communication with the liquid-side stop valve.

6 Claims, 8 Drawing Sheets

VARIABLE REFRIGERANT FLOW SYSTEM AND CONTROL METHOD

FOREIGN PRIORITY

This application claims priority to Chinese Patent Application No. 202210314446.6, filed Mar. 28, 2022, and all the benefits accruing therefrom under 35 U.S.C. § 119, the contents of which in its entirety are herein incorporated by reference.

TECHNICAL FIELD OF INVENTION

The present invention relates to the field of air conditioning and heat pump technologies, and in particular, to a variable refrigerant flow (VRF) system and a control method.

BACKGROUND OF THE INVENTION

In an existing VRF, an outdoor unit only includes one function. For example, if it needs to be able to achieve heat recovery for preparing hot water, an outdoor unit having a hydraulic module is required to be arranged. If it needs to be able to achieve non-stop defrosting, an outdoor unit having a phase-change heat storage module is required to be arranged. In view of the existing technology, structures of outdoor units having different functions are quite different, and therefore, the above selection work must be made at a design stage of outdoor units. If it reaches a subsequent device purchasing and transportation stage, or after outdoor units arrive at the site, adjusting functions of the outdoor units may be very difficult. In addition, in order to improve the delivery period, some outdoor units may be prepared in advance as inventory and placed in a warehouse, and it is further necessary to prepare some inventory for outdoor units having different functions. In this way, the warehouse cost is greatly increased, but for the existing VRF systems, it is difficult to quickly respond to market demands without warehousing.

Therefore, how to provide a VRF system that can reduce differences in internal structures of VRF systems having different functions, improve the degree of modularization or the degree of universalization of components, so as to achieve rapid change or adjustment of the VRF systems having different functions, is a subject that the existing technology faces.

SUMMARY OF THE INVENTION

In view of the above problems, in order to reduce differences in internal structures of VRF systems having different functions, improve the degree of modularization or the degree of universalization of components, so as to achieve rapid change or adjustment of the VRFs having different functions, the present invention provides a VRF system, including: a first outdoor unit, the first outdoor unit at least including three external interfaces, namely, a gas-side stop valve, a liquid-side stop valve, and a multi-functional pipe stop valve; a first indoor unit, two ends of a refrigerant pipeline of the first indoor unit being respectively in communication with the gas-side stop valve and the liquid-side stop valve; a replaceable module, one end of a refrigerant pipeline of the replaceable module being in communication with the multi-functional pipe stop valve, and the other end being in communication with the liquid-side stop valve.

According to the technical solution provided by the present invention, in addition to the gas-side stop valve and the liquid-side stop valve, the first outdoor unit further has an external interface including a multi-functional pipe stop valve, and therefore, the external interface may be used for connecting the replaceable module, and the replaceable module may enable the VRF to have different functions. In particular, in the technical solution provided by the present invention, in addition to the different replaceable modules used for realizing different functions, other structures of the VRF systems having different functions are the same, and components may be universal to each other, thus reducing differences in internal structures of the VRF systems having different functions, and improving the degree of modularization or the degree of universality of the components. The technical solution may cooperate with replaceable modules to achieve different functions according to requirements of a customer when the VRF system reaches the site of the customer or during selection of accessories for outdoor units, thereby reducing the cost of the VRF system at various stages from design to installation.

In a preferred technical solution of the present invention, the replaceable module includes one or more of a phase-change heat storage module, a hydraulic module, a second outdoor unit, or a second indoor unit.

According to the preferred technical solution, if the replaceable module is a phase-change heat storage module, the phase-change heat storage module can store heat during shutdown or operation of the system, so that a valve that controls heating of the first indoor unit does not change direction during defrosting, realizing a phase-change heat storage non-stop defrosting function. If the replaceable module is a hydraulic module, and the hydraulic module can realize heat recovery and prepare hot water at the same time of refrigeration or heating of the VRF system. If the replaceable module is a second outdoor unit, parallel non-stop defrosting of outdoor units or zoning control of indoor units may be realized. If the replaceable module is a second indoor unit, the second indoor unit and the first indoor unit may enter different control modes at different zones. Optionally, structures of the second outdoor unit and the first outdoor unit may be the same, and structures of the second indoor unit and the first indoor unit may also be the same, which can improve the degree of modularization of the VRF and reduce the warehouse cost.

In the preferred technical solution of the present invention, the replaceable module is a second outdoor unit, the second outdoor unit has a second multi-functional pipe stop valve, and the second multi-functional pipe stop valve is in communication with the multi-functional pipe stop valve.

According to the preferred technical solution, because the second outdoor unit has a second multi-functional pipe stop valve, on the one hand, the second multi-functional pipe stop valve is in communication with the multi-functional pipe stop valve of the first outdoor unit to realize the parallel non-stop defrosting function of the outdoor units; on the other hand, the second multi-functional pipe stop valve may be connected to a replaceable module, such as the phase-change heat storage module, the hydraulic module, and the second outdoor unit. In other words, the replaceable module connected to the multi-functional pipe stop valve of the first outdoor unit is the second outdoor unit and is in communication with the second multi-functional pipe stop valve of the second outdoor unit, while the second multi-functional pipe stop valve may also be connected to another replaceable module. Optionally, a third outdoor unit may be connected to the second multi-functional pipe stop valve to realize the zoning control of the indoor units.

In the preferred technical solution of the present invention, the second outdoor unit includes a second gas-side pipe stop valve and a second liquid-side pipe stop valve, and both the second gas-side pipe stop valve and the second liquid-side pipe stop valve are in communication with the first indoor unit.

According to the preferred technical solution, the second outdoor unit can cooperate with the first indoor unit to complete a heat pump cycle (refrigeration cycle/heating cycle). Further, the second liquid-side pipe stop valve is in communication with the liquid-side pipe stop valve, and the second gas-side pipe stop valve is in communication with the gas-side pipe stop valve, so that the first outdoor unit can cooperate with the second outdoor unit to complete the heat pump cycle.

In the preferred technical solution of the present invention, the replaceable module is a second indoor unit, and an end of the second indoor unit in communication with the liquid-side stop valve is in communication with the first indoor unit.

According to the preferred technical solution, the replaceable module is the second indoor unit, and the second indoor unit and the first indoor unit may enter different control modes at different zones. Both the first indoor unit and the second indoor unit can cooperate with the first outdoor unit to complete the heat pump cycle. At the same time, because the end of the second indoor unit in communication with the liquid-side stop valve is in communication with the first indoor unit, the first indoor unit can further cooperate with the second indoor unit to complete the heat pump cycle. Optionally, the structure of the second indoor unit is the same as that of the first indoor unit to improve the degree of modularization of the VRF system.

In the preferred technical solution of the present invention, the outdoor unit at least includes three four-way valves: a four-way valve I, a four-way valve II, and a four-way valve III, wherein an exhaust end of the four-way valve I, an exhaust end of the four-way valve II, and an exhaust end of the four-way valve III are in communication with each other, and are jointly in communication with an exhaust end of the compressor. An indoor unit connecting end of the four-way valve I is in communication with the gas-side pipe stop valve; an outdoor unit connecting end of the four-way valve II is in communication with the liquid-side pipe stop valve; an outdoor unit connecting end of the four-way valve III is in communication with the multi-functional pipe stop valve; an air-return end and an outdoor unit connecting end of the four-way valve I, an air-return end and an indoor unit connecting end of the four-way valve II, and an air-return end and an indoor unit connecting end of the four-way valve III are all in communication with each other, and are jointly in communication with a suction end of the compressor.

According to the preferred technical solution, the plurality of four-way valves may provide more options for the replaceable module and realize more abundant functions. In particular, the outdoor unit connecting end of the four-way valve III is in communication with the multi-functional pipe stop valve, which can send a gaseous refrigerant discharged by the compressor into the replaceable module, thereby extending the function that can be realized by the replaceable module.

The air-return end and the outdoor unit connecting end of the four-way valve I are in communication with each other, and are jointly in communication with the suction end of the compressor. The air-return end and the indoor unit connecting end of the four-way valve II are in communication with each other, and are jointly in communication with the suction end of the compressor. The air-return end and the indoor unit connecting end of the four-way valve III are in communication with each other, and are jointly in communication with the suction end of the compressor.

The present invention further provides a control method for controlling the VRF system in any of the above technical solutions. After the VRF is powered on, the following steps are performed: detecting the replaceable module in communication with the multi-functional pipe stop valve, controlling, in response to that the replaceable module is detected, the VRF system to operate in a mode matching the replaceable module, and controlling, when the replaceable module is not detected, the VRF system to operate in a normal mode.

According to the technical solution provided by the present invention, after the VRF system is powered on, it will automatically detect whether there is a replaceable module, and control, in response to that the replaceable module is detected, the VRF system to operate in a mode matching the replaceable module. Further, when there are a plurality of modes matching the replaceable module, the operation mode of the VRF system is determined according to an enabled dial. Therefore, it is preferable that the VRF system responds to the functional modules (the phase-change heat storage module and the hydraulic module), the second outdoor unit, and the second indoor unit in sequence, because the operation mode matching the functional module is single, while the operation mode matching the second outdoor unit and the second indoor unit is relatively abundant.

In the preferred technical solution of the present invention, the replaceable module is the second indoor unit. In response to that the second outdoor unit is detected, the VRF system is controlled to operate in a zoning control mode of indoor units. The zoning control mode of indoor units includes a main refrigeration control mode, a main heating control mode, a full heating control mode, and a full refrigeration control mode.

The main refrigeration control mode is controlling a part of a refrigerant discharged by the compressor to enter the second indoor unit through the multi-functional pipe stop valve for primary heat exchange, and the other part of the refrigerant to perform primary heat exchange in the first outdoor unit, and controlling the refrigerant after the primary heat exchange to jointly enter the first indoor unit for secondary heat exchange. The main heating control mode is controlling the refrigerant discharged by the compressor to pass through the multi-functional pipe stop valve and then enter the second indoor unit for primary heat exchange, and controlling a part of the refrigerant after the primary heat exchange to enter the first indoor unit for secondary heat exchange, and the other part of the refrigerant to enter the first outdoor unit for secondary heat exchange. The full refrigeration control mode is controlling the refrigerant discharged by the compressor to perform primary heat exchange in the first outdoor unit, and controlling a part of the refrigerant after the primary heat exchange to enter the first indoor unit for secondary heat exchange, and the other part of the refrigerant to enter the second indoor unit for secondary heat exchange. The full heating control mode is controlling a part of the refrigerant discharged by the compressor to enter the second indoor unit through the multi-functional pipe stop valve for primary heat exchange, and the other part of the refrigerant to enter the first indoor unit through the gas-side stop valve for primary heat exchange, and controlling the refrigerant after the primary heat exchange to jointly perform secondary heat exchange in the first outdoor unit.

According to the preferred technical solution, the VRF system can provide users with more diversified function options in a more fixed structure.

Figure 1:
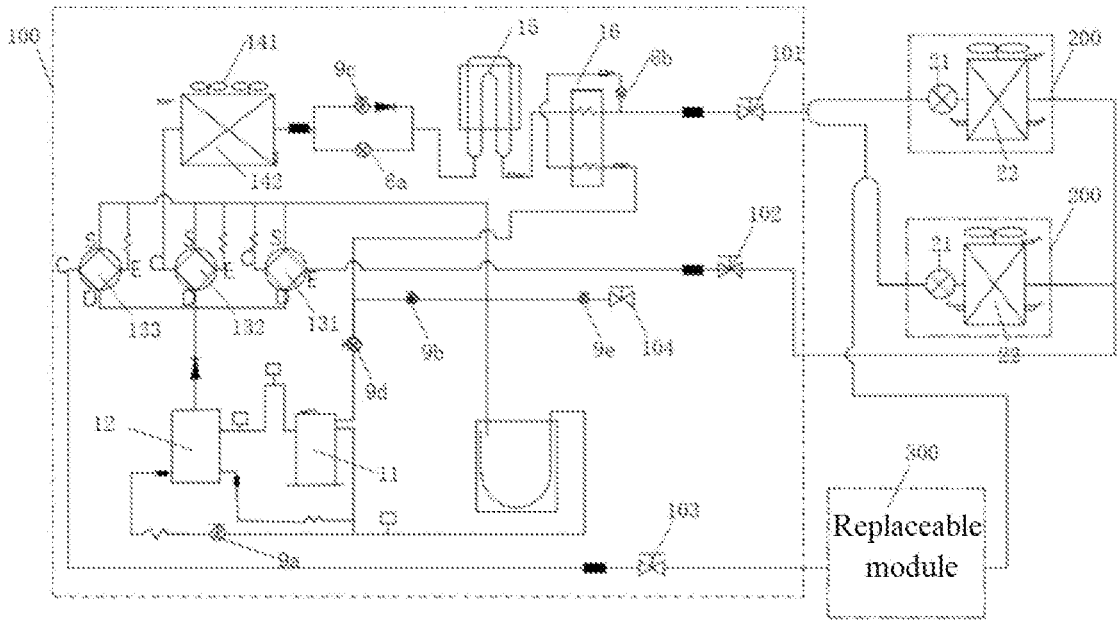
FIG. 1 is a schematic structural diagram of a VRF system according to Embodiment 1 of the present invention.

Reference numerals: First outdoor unit 100, Compressor 11, Oil separator 12, Four-way valve I 131, Four-way valve II 132, Four-way valve III 133, Outdoor fan 141, Outdoor finned heat exchanger 142, Compressor heat-dissipation module 15, Plate heat exchanger 16, Gas-liquid separator 17, Liquid-side stop valve 101, Gas-side stop valve 102, Multi-functional pipe stop valve 103, Filling needle valve 104, Second liquid-side stop valve 1012, Second gas-side stop valve 1022, Second multi-functional pipe stop valve 1032, Exhaust end D of the four-way valve (I, II, III), Outdoor unit connecting end C of the four-way valve (I, II, III), Indoor unit connecting end E of the four-way valve (I, II, III), Air-return end S of the four-way valve (I, II, III), First indoor unit 200, Indoor electronic expansion valve 21, Indoor heat exchanger 22, Replaceable module 300, Second outdoor unit 400, Second indoor unit 500, Third indoor unit 600, Solenoid valve I 9*a*, Solenoid valve II 9*b*, Solenoid valve III 9*c*, Solenoid valve IV 9*d*, Solenoid valve V 9*e*, Electronic expansion valve I 8*a*, and Electronic expansion valve II 8*b*.

DETAILED DESCRIPTION OF THE INVENTION

The technical solution in the embodiments of the present invention will be described clearly and completely with reference to the accompanying drawings in the embodiments of the present invention. Obviously, the described embodiments are only part of the embodiments of the present invention, not all of the embodiments. Based on the embodiments in the present invention, all other embodiments obtained by those of ordinary skill in the art without creative efforts fall within the protection scope of the present invention.

Embodiment 1

This embodiment provides a VRF system that can reduce differences in internal structures of VRF systems having different functions, improve the degree of modularization or the degree of universalization of components, so as to realize the rapid change or adjustment of the VRF systems having different functions, including: a first outdoor unit 100, the first outdoor unit 100 at least including three external interfaces, namely, a gas-side stop valve 102, a liquid-side stop valve 101, and a multi-functional pipe stop valve 103; a first indoor unit 200, two ends of a refrigerant pipeline of the first indoor unit 200 being respectively in communication with the gas-side stop valve and the liquid-side stop valve 101; a replaceable module 300, one end of a refrigerant pipeline of the replaceable module 300 being in communication with the multi-functional pipe stop valve 103, and the other end being in communication with the liquid-side stop valve 101.

Further, one end of the replaceable module 300 in communication with the liquid-side stop valve 101 is in communication with the first indoor unit 200 at the same time. In other words, the replaceable module 300 is in communication with the first indoor unit 200, and they are jointly in communication with the liquid-side stop valve 101.

In this embodiment, the replaceable module 300 is optionally a phase-change heat storage module. The phase-change heat storage module can store heat during shutdown or operation of the system, so that a valve that controls heating of the first indoor unit 200 does not change direction during defrosting, thereby realizing a phase-change heat storage non-stop defrosting function. The replaceable module 300 is further optionally a hydraulic module. The hydraulic module can realize heat recovery, and prepare hot water at the same time of refrigeration or heating of the VRF system.

The structure of phase-change heat storage module or hydraulic module may be designed by those skilled in the art according to requirements.

Generally speaking, only one replaceable module 300 can be connected between one multi-functional pipe stop valve 103 and the liquid-side stop valve 101, but a plurality of replaceable modules 300 may be connected by arranging a plurality of multi-functional pipe stop valves 103.

According to the technical solution provided by this embodiment, in addition to the gas-side stop valve 102 and the liquid-side stop valve 101, the first outdoor unit 100 further has an external interface including a multi-functional pipe stop valve 103. The external interface may be used for connecting the replaceable module 300, and the replaceable module 300 may enable the VRF to have different functions. In particular, in the technical solution provided by the present invention, in addition to the different replaceable modules 300 used for realizing different functions, other structures of the VRF systems having different functions are the same, and components may be universal to each other, thus reducing differences in internal structures of the VRF systems having different functions, and improving the degree of modularization. The technical solution provided in this embodiment may cooperate with replaceable modules 300 to achieve different functions according to requirements of a customer when the VRF system reaches the site of the customer or during selection of accessories for outdoor units, thereby reducing the cost of the VRF system at various stages from design to installation.

FIG. 1 is a structural diagram of a VRF system in this embodiment, including a first outdoor unit 100, a plurality of first indoor units 200, and a replaceable module 300. The first indoor unit 200 includes an indoor electronic expansion valve 21 and an indoor heat exchanger 22. The first outdoor unit 100 includes a compressor 11, an oil separator 12, a four-way valve I 131, a four-way valve II 132, a four-way valve III 133, an outdoor fan 141, an outdoor finned heat exchanger 142, a compressor heat-dissipation module 15, a plate heat exchanger 16, a gas-liquid separator 17, and four external interfaces, namely, a liquid-side stop valve 101, a gas-side stop valve 102, a multi-functional pipe stop valve 103, and a filling needle valve 104.

An exhaust end D of the four-way valve I 131, an exhaust end D of the four-way valve II 132, and an exhaust end D of the four-way valve III 133 are in communication with each other, and are jointly in communication with an exhaust end of the compressor 11. An indoor unit connecting end E of the four-way valve I 131 is in communication with the gas-side pipe stop valve 102. An outdoor unit connecting end C of the four-way valve II 132 is in communication with the liquid-side pipe stop valve 101. An outdoor unit connecting end C of the four-way valve III 133 is in communication with the multi-functional pipe stop valve 103. An air-return end S and an outdoor unit connecting end C of the four-way valve I 131, an air-return end S and an indoor unit connecting end E of the four-way valve II 132, and an air-return end S and an indoor unit connecting end E of the four-way valve III 133 are all in communication with each other, and they are in communication with a suction end of the compressor 11 through the gas-liquid separator 17.

The outdoor finned heat exchanger 142, the compressor heat-dissipation module 15, and the plate heat exchanger 16 are successively connected between the outdoor unit connecting end C of the four-way valve II 132 and the liquid-side pipe stop valve 101. The outdoor fan 141 is arranged on the outdoor finned heat exchanger 142, an electronic expansion valve II **8*b* is connected to the plate heat exchanger 16, and a solenoid valve III 9*c* and an electronic expansion valve I 8*a* are arranged in parallel between the outdoor finned heat exchanger 142 and the compressor heat-dissipation module 15**.

A solenoid valve II **9*b* and a solenoid valve V 9*e* are arranged between the compressor 11 and the filling needle valve 104, a solenoid valve IV 9*d* is arranged between the plate heat exchanger 16 and the compressor 11, and a solenoid valve I 9*a* is arranged between the oil separator 12 and the gas-liquid separator 17**.

Embodiment 2

The VRF system provided in this embodiment is different from Embodiment 1 in that the replaceable module 300 in this embodiment is a second outdoor unit 400.

Figure 2:
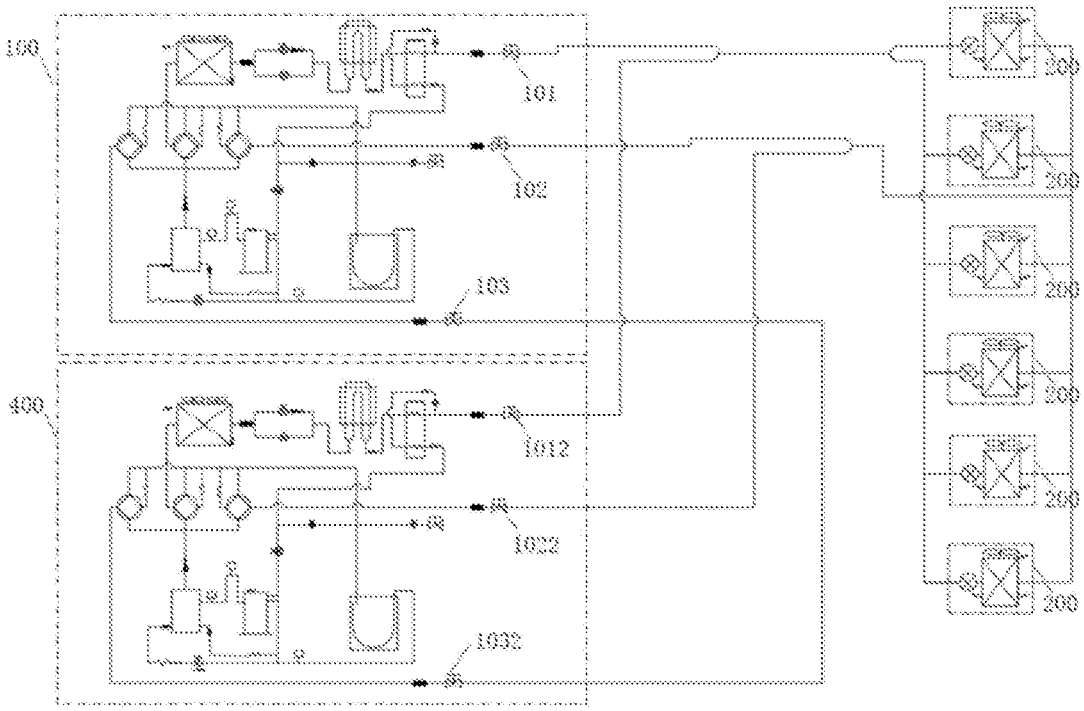
FIG. 2 is a schematic structural diagram of a VRF system according to Embodiment 2 of the present invention.

Referring to FIG. 2, the VRF system has a first outdoor unit 100, the second outdoor unit 400, and a plurality of first indoor units 200. The first outdoor unit 100 has three external interfaces, namely, a liquid-side stop valve 101, a gas-side stop valve 102, and a multi-functional pipe stop valve 103. The second outdoor unit 400 also has three external interfaces, namely, a second liquid-side stop valve 1012, a second gas-side stop valve 1022, and a second multi-functional pipe stop valve 1032. An internal structure of the second outdoor unit 400 in this embodiment is the same as that of the first outdoor unit 100, and the internal structure of the first outdoor unit 100 in this embodiment is the same as that in Embodiment 1, and will not be repeated here.

The second outdoor unit 400 has the second multi-functional pipe stop valve 1032, and the second multi-functional pipe stop valve 1032 is in communication with the multi-functional pipe stop valve 103. The second outdoor unit 400 includes a second gas-side pipe stop valve and a second liquid-side pipe stop valve, and both the second gas-side pipe stop valve and the second liquid-side pipe stop valve are in communication with the first indoor unit 200.

In this embodiment, the second outdoor unit 400 connected to the multi-functional pipe stop valve 103 cooperates with the first outdoor unit 100 to complete a heat pump cycle, which can realize parallel non-stop defrosting of outdoor units.

Figure 3:
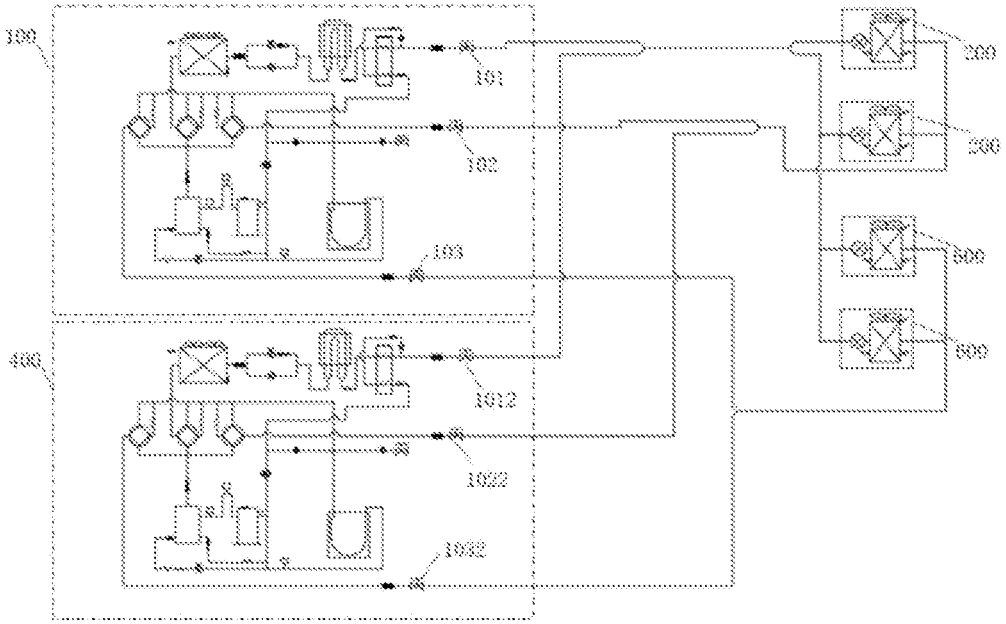
FIG. 3 is a schematic structural diagram of a VRF system according to Embodiment 2 of the present invention.

Optionally, referring to FIG. 3, a third indoor unit 600 is arranged between the second multi-functional pipe stop valve 1032 and the second liquid-side stop valve 1012 of the second outdoor unit 400, so that zoning control of the first indoor unit 200 and the third indoor unit 600 can be realized.

In other words, when the replaceable module 300 connected to the multi-functional pipe stop valve 103 of the first outdoor unit 100 is the second outdoor unit 400, the VRF system can realize different functions according to different connection relationships of the second multi-functional pipe stop valve 1032 on the second outdoor unit 400. When the second multi-functional pipe stop valve 1032 is only connected to the multi-functional pipe stop valve 103, the VRF system realizes the parallel non-stop defrosting of outdoor units. When the second multi-functional pipe stop valve 1032 is not only connected to the multi-functional pipe stop valve 103, but also connected to the third indoor unit 600, the VRF system realizes the zoning control of the first indoor unit 200 and the third indoor unit 600.

Embodiment 3

The VRF system provided in this embodiment is different from Embodiment 1 in that the replaceable module 300 in this embodiment is a second indoor unit 500.

Figure 4:
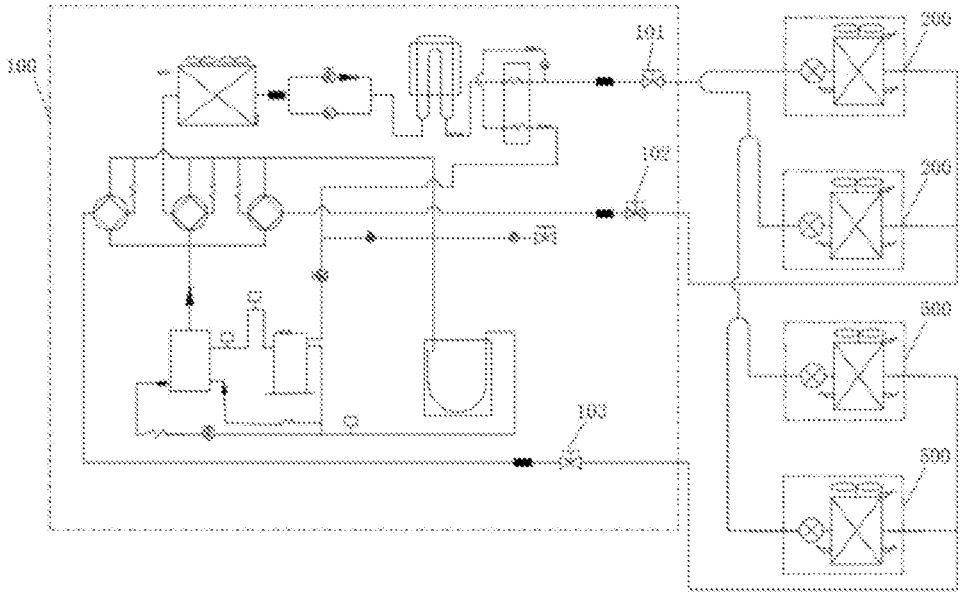
FIG. 4 is a schematic structural diagram of a VRF system according to Embodiment 3 of the present invention.

Referring to FIG. 4, the VRF system has a first outdoor unit 100, a plurality of first indoor units 200, and a plurality of second indoor units 500. The first outdoor unit 100 has three external interfaces, namely, a liquid-side stop valve 101, a gas-side stop valve 102, and a multi-functional pipe stop valve 103. One end of the second indoor unit 500 in communication with the liquid-side stop valve 101 is in communication with the first indoor unit 200 at the same time. The internal structure of the first outdoor unit 100 in this embodiment is the same as that in Embodiment 1, and will not be repeated here.

According to the technical solution provided by this embodiment, the replaceable module 300 is the second indoor unit 500, and the second indoor unit 500 and the first indoor unit 200 can enter different control modes at different zones. Both the first indoor unit 200 and the second indoor unit 500 can cooperate with the first outdoor unit 100 to complete the heat pump cycle. At the same time, because the end of the second indoor unit 500 in communication with the liquid-side stop valve 101 is in communication with the first indoor unit 200, the first indoor unit 200 can also cooperate with the second indoor unit 500 to complete the heat pump cycle.

Embodiment 4

This embodiment provides a control method of a VRF system. After the VRF system is powered on, the following steps are performed: detecting the replaceable module 300 in communication with the multi-functional pipe stop valve 103, controlling, in response to that the replaceable module 300 is detected, the VRF system to operate in a mode matching the replaceable module 300, and controlling, when the replaceable module 300 is not detected, the VRF system to operate in a normal mode.

Figure 5:
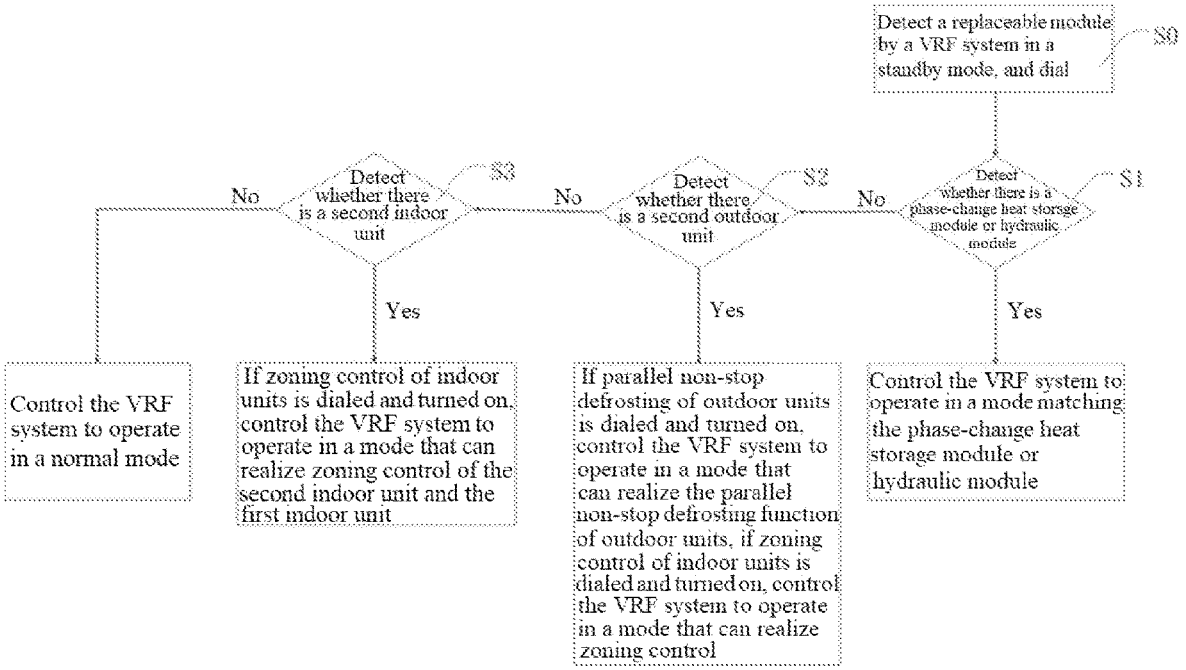
FIG. 5 is a flow chart of a control method of a VRF system according to Embodiment 4 of the present invention.

Specifically, referring to FIG. 5, the VRF system is controlled to perform the following steps:

Step S0: Detect the replaceable module 300 by the VRF system in a standby mode, and dial.

Step S1: Detect whether there is a phase-change heat storage module or hydraulic module, if a detection result is yes, control the VRF system to operate in a mode matching the phase-change heat storage module or hydraulic module, and if the detection result is no, perform step S2.

Step S2: Detect whether there is a second outdoor unit 400, and when the second outdoor unit 400 is detected, if parallel non-stop defrosting of outdoor units is dialed and turned on, control the VRF system to operate in a mode that can realize the parallel non-stop defrosting function of outdoor units, if zoning control of indoor units is dialed and turned on, control the VRF system to operate in a mode that can realize zoning control, and if the second outdoor unit 400 is not detected, perform step S3.

Step S3: Detect whether there is a second indoor unit 500, when the second indoor unit 500 is detected, if zoning control of indoor units is dialed and turned on, control the VRF system to operate in a mode that can realize zoning control of the second indoor unit 500 and the first indoor unit 200, and if the second indoor unit 500 is not detected, control the VRF system to operate in a normal mode.

According to the technical solution provided by this embodiment, after the VRF system is powered on, it will automatically detect whether there is a replaceable module 300, and the VRF system is controlled, in response to that the replaceable module 300 is detected, to operate in a mode matching the replaceable module 300. Further, when there are a plurality of modes matching the replaceable module 300, the operation mode of the VRF system is determined according to the turned-on dial.

Further, when the replaceable module 300 is the second indoor unit 500, in response to that the second outdoor unit 400 is detected, the VRF system is controlled to operate in the zoning control mode of indoor units. The zoning control mode of indoor units includes a main refrigeration control mode, a main heating control mode, a full refrigeration control mode, and a full heating control mode.

Figure 6:
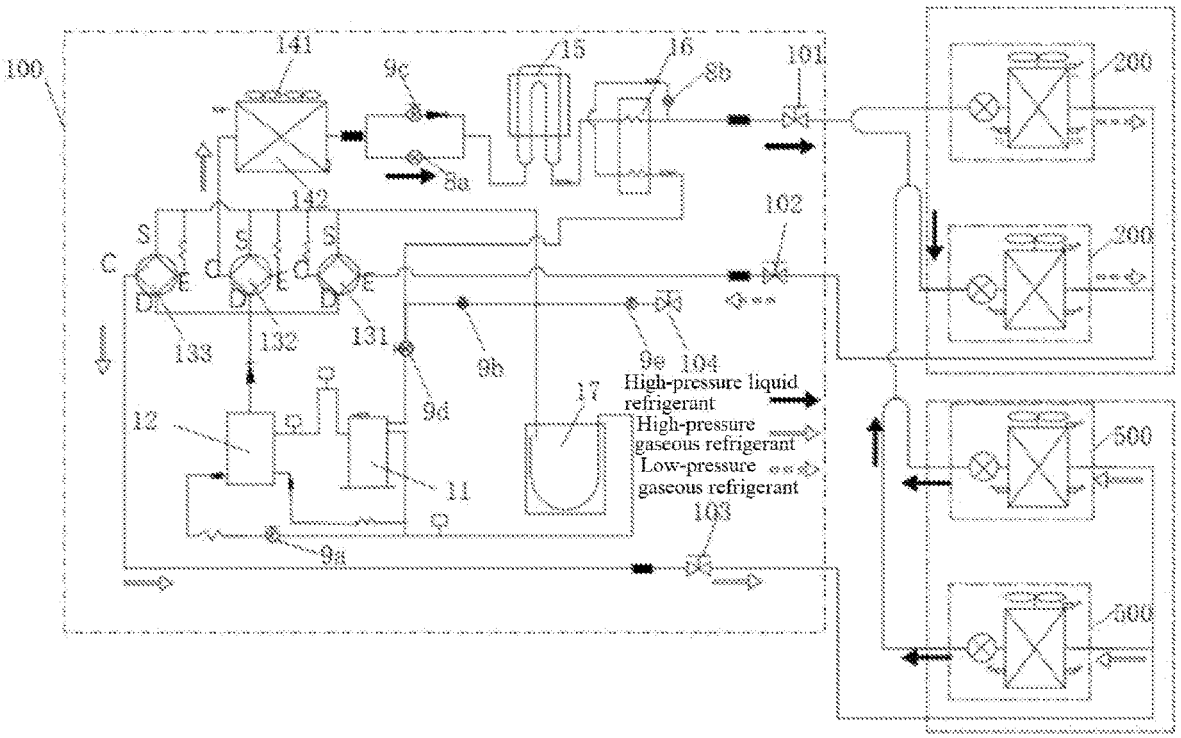
FIG. 6 is a schematic diagram of a main refrigeration control mode in the control method of a VRF system according to Embodiment 4 of the present invention.

Referring to FIG. 6, the main refrigeration control mode is controlling a part of a high-pressure gaseous refrigerant discharged by the compressor 11 to enter the second indoor unit 500 through the multi-functional pipe stop valve 103 for primary heat exchange, and the other part of the refrigerant to perform primary heat exchange in the first outdoor unit 100 (through the outdoor finned heat exchanger 142), and controlling the high-pressure liquid refrigerant after the primary heat exchange to jointly enter the first indoor unit 200 for secondary heat exchange. The low-pressure gaseous refrigerant after the secondary heat exchange returns to the compressor 11 through the gas-side stop valve 102 and the four-way valve I 131 in sequence.

Figure 7:
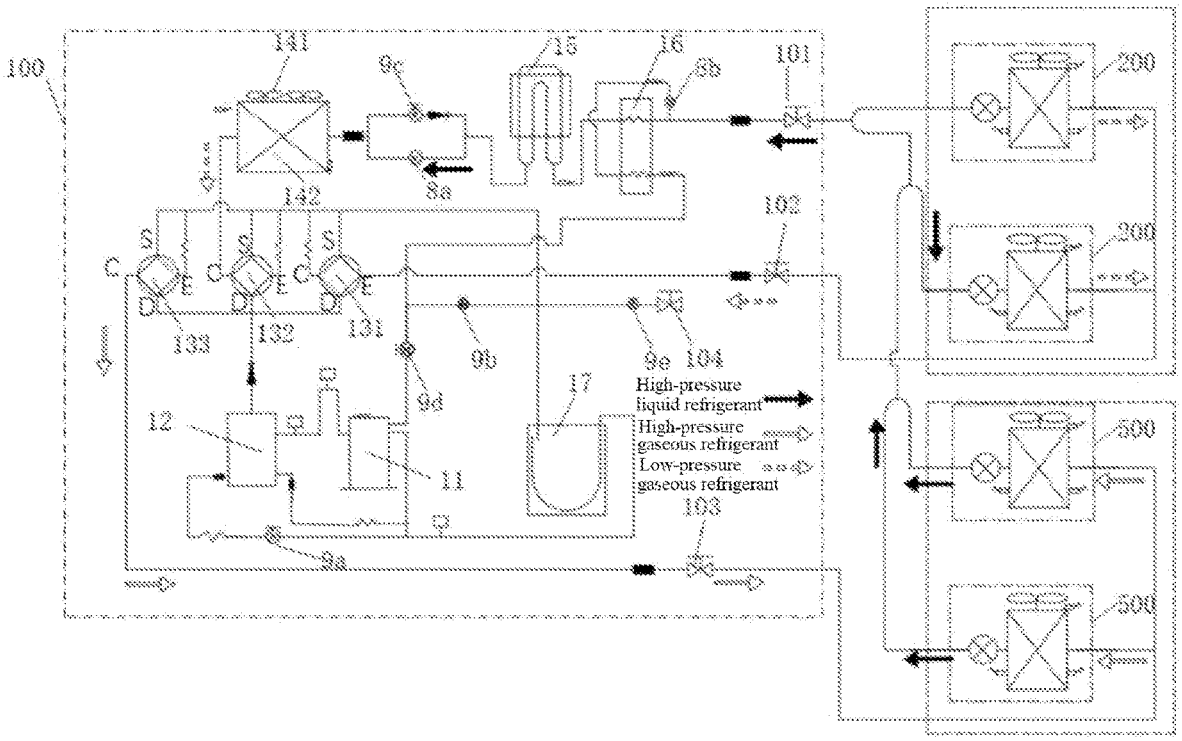
FIG. 7 is a schematic diagram of a main heating control mode in the control method of a VRF system according to Embodiment 4 of the present invention.

Referring to FIG. 7, the main heating control mode is controlling the high-pressure gaseous refrigerant discharged by the compressor 11 to pass through the multi-functional pipe stop valve 103 and then enter the second indoor unit 500 for primary heat exchange, and controlling a part of the high-pressure liquid refrigerant after the primary heat exchange to enter the first indoor unit 200 for secondary heat exchange, where this part of low-pressure gaseous refrigerant after the secondary heat exchange returns to the compressor 11 through the gas-side stop valve 102 and the four-way valve I 131 in sequence, and the other part of the refrigerant to enter the first outdoor unit 100 for secondary heat exchange, wherein this part of low-pressure gaseous refrigerant after the secondary heat exchange returns to the compressor 11 through the four-way valve I 131.

Figure 8:
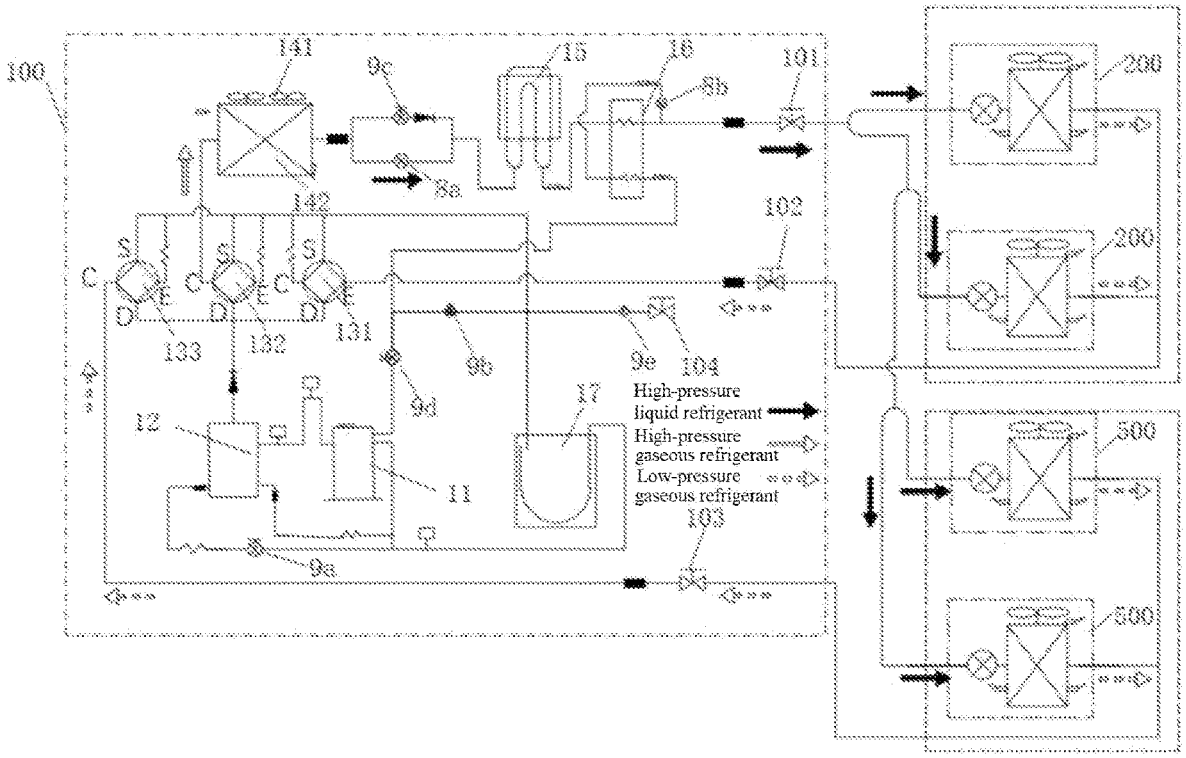
FIG. 8 is a schematic diagram of a full refrigeration control mode in the control method of a VRF system according to Embodiment 4 of the present invention.

Referring to FIG. 8, the full refrigeration control mode is controlling the high-pressure gaseous refrigerant discharged by the compressor 11 to perform primary heat exchange in the first outdoor unit 100, and controlling a part of the high-pressure liquid refrigerant after the primary heat exchange to enter the first indoor unit 200 for secondary heat exchange, wherein this part of low-pressure gaseous refrigerant after the secondary heat exchange returns to the compressor 11 through the gas-side stop valve 102 and the four-way valve I 131 in sequence; and the other part of the refrigerant to enter the second indoor unit 500 for secondary heat exchange, wherein this part of low-pressure gaseous refrigerant after the secondary heat exchange returns to the compressor 11 through the multi-functional pipe stop valve 103 and the four-way valve III 133 in sequence.

Figure 9:
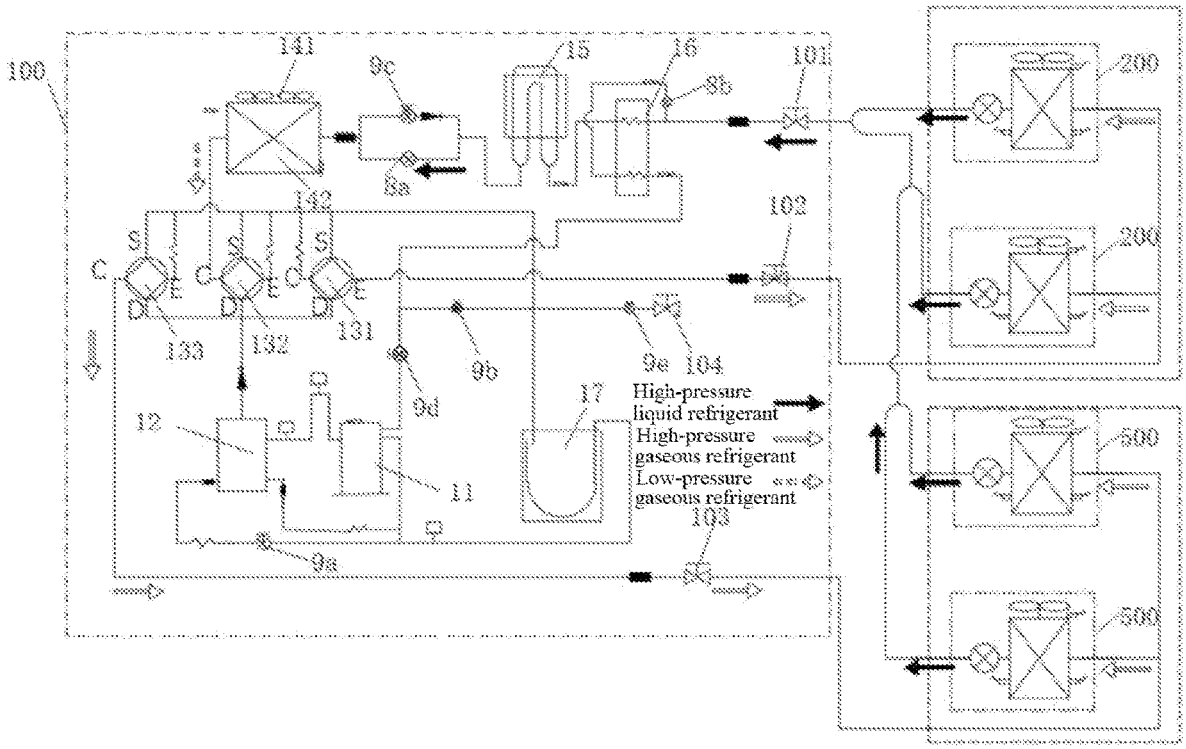
FIG. 9 is a schematic diagram of a full heating control mode in the control method of a VRF system according to Embodiment 4 of the present invention.

Referring to FIG. 9, the full heating control mode is controlling a part of the high-pressure gaseous refrigerant discharged by the compressor 11 to enter the second indoor unit 500 through the multi-functional pipe stop valve 103 for primary heat exchange, and the other part of the refrigerant to enter the first indoor unit 200 through the gas-side stop valve 102 for primary heat exchange, and controlling the high-pressure liquid refrigerant after the primary heat exchange to jointly perform secondary heat exchange in the first outdoor unit 100. The low-pressure gaseous refrigerant after the secondary heat exchange returns to the compressor 11 through the four-way valve II 132.

Figure 10:
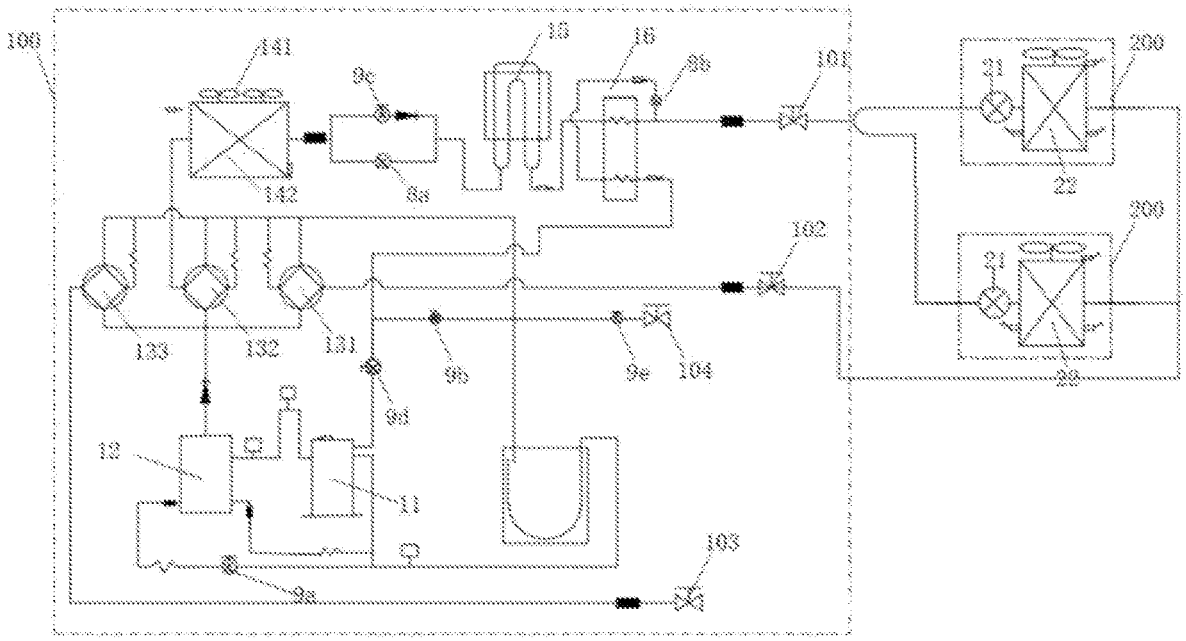
FIG. 10 is a schematic diagram of the control method of a VRF system according to Embodiment 4 of the present invention that operates in a normal mode.

Finally, referring to FIG. 10, if the multi-functional pipe stop valve 103 is not connected to any structure, it operates in a normal mode. Specifically, during refrigeration, the high-pressure gaseous refrigerant discharged by the compressor 11 is controlled to enter the outdoor finned heat exchanger 142 through the four-way valve II 132 for primary heat exchange, and then enter the first indoor unit 200 for secondary heat exchange. During heating, the high-pressure gaseous refrigerant discharged by the compressor 11 is controlled to enter the first indoor unit 200 through the four-way valve I 131 for primary heat exchange, and then enter the outdoor finned heat exchanger 142 for secondary heat exchange.

The above is only preferred embodiments of the present invention and is not intended to limit the present invention. Any modification, equivalent replacement, and improvement made within the spirit and principle of the present invention shall be included in the protection scope of the present invention.

What is claimed is:

1. A control method of a VRF system, the VRF system comprising:

a first outdoor unit, the first outdoor unit at least comprising three external interfaces, namely, a gas-side stop valve, a liquid-side stop valve, and a multi-functional pipe stop valve;

a first indoor unit, two ends of a refrigerant pipeline of the first indoor unit being respectively in communication with the gas-side stop valve and the liquid-side stop valve; and a replaceable module, one end of a refrigerant pipeline of the replaceable module being in communication with the multi-functional pipe stop valve, and the other end being in communication with the liquid-side stop valve, wherein the replaceable module comprises one or more of a phase-change heat storage module, a hydraulic module, a second outdoor unit, or a second indoor unit;

wherein the outdoor unit at least comprises three four-way valves: a four-way valve I, a four-way valve II, and a four-way valve III;

wherein an exhaust end of the four-way valve I, an exhaust end of the four-way valve II, and an exhaust end of the four-way valve III are in communication with each other, and are jointly in communication with an exhaust end of a compressor;

an indoor unit connecting end of the four-way valve I is in communication with the gas-side pipe stop valve;

an outdoor unit connecting end of the four-way valve II is in communication with the liquid-side pipe stop valve;

an outdoor unit connecting end of the four-way valve III is in communication with the multi-functional pipe stop valve;

an air-return end and an outdoor unit connecting end of the four-way valve I, an air-return end and an indoor unit connecting end of the four-way valve II, and an air-return end and an indoor unit connecting end of the four-way valve III are all in communication with each other, and are jointly in communication with a suction end of the compressor;

wherein after the VRF system is powered on, the following steps are performed:

detecting the replaceable module in communication with the multi-functional pipe stop valve, controlling, in response to that the replaceable module is detected, the VRF system to operate in a mode matching the replaceable module, and controlling, when the replaceable module is not detected, the VRF system to operate in a normal mode.

2. The control method according to claim 1, wherein the replaceable module is a second outdoor unit, the second outdoor unit has a second multi-functional pipe stop valve, and the second multi-functional pipe stop valve is in communication with the multi-functional pipe stop valve.

3. The control method according to claim 2, wherein the second outdoor unit comprises a second gas-side pipe stop valve and a second liquid-side pipe stop valve, and both the second gas-side pipe stop valve and the second liquid-side pipe stop valve are in communication with the first indoor unit.

4. The control method according to claim 1, wherein the replaceable module is a second indoor unit, and one end of the second indoor unit in communication with the liquid-side stop valve is in communication with the first indoor unit.

5. The control method of the VRF system according to claim 1, wherein the replaceable module is a second indoor unit, and the VRF system is controlled, in response to that the second outdoor unit is detected, to operate in an indoor unit zoning control mode, and the indoor unit zoning control mode comprises a main refrigeration control mode, a main heating control mode, a full refrigeration control mode, and a full heating control mode.

6. The control method of the VRF system according to claim 5, wherein the main refrigeration control mode is controlling a part of a refrigerant discharged by the compressor to enter the second indoor unit through the multi-functional pipe stop valve for primary heat exchange, and the other part of the refrigerant to perform primary heat exchange in the first outdoor unit, and controlling the refrigerant after the primary heat exchange to jointly enter the first indoor unit for secondary heat exchange;

the main heating control mode is controlling the refrigerant discharged by the compressor to pass through the multi-functional pipe stop valve and then enter the second indoor unit for primary heat exchange, and controlling a part of the refrigerant after the primary heat exchange to enter the first indoor unit for secondary heat exchange, and the other part of the refrigerant to enter the first outdoor unit for secondary heat exchange;

the full refrigeration control mode is controlling the refrigerant discharged by the compressor to perform primary heat exchange in the first outdoor unit, and controlling a part of the refrigerant after the primary heat exchange to enter the first indoor unit for secondary heat exchange, and the other part of the refrigerant to enter the second indoor unit for secondary heat exchange; and the full heating control mode is controlling a part of the refrigerant discharged by the compressor to enter the second indoor unit through the multi-functional pipe stop valve for primary heat exchange, and the other part of the refrigerant to enter the first indoor unit through the gas-side stop valve for primary heat exchange, and controlling the refrigerant after the primary heat exchange to jointly perform secondary heat exchange in the first outdoor unit.

* * * * *